US008579489B2

(12) United States Patent
Edamitsu et al.

(10) Patent No.: US 8,579,489 B2
(45) Date of Patent: Nov. 12, 2013

(54) ILLUMINATOR ALLOWING A WIDE LUMINOUS INTENSITY DISTRIBUTION

(75) Inventors: Takashi Edamitsu, Kitasaku-gun (JP); Satoru Chosokabe, Kitasaku-gun (JP); Masaya Terasaki, Kitasaku-gun (JP); Kazuhiro Tanaka, Kitasaku-gun (JP)

(73) Assignee: Minebea Co., Ltd., Kitasaku-gun (JP)

( * ) Notice: Subject to any disclaimer, the term of this patent is extended or adjusted under 35 U.S.C. 154(b) by 100 days.

(21) Appl. No.: 13/311,076

(22) Filed: Dec. 5, 2011

(65) Prior Publication Data

US 2012/0163024 A1 Jun. 28, 2012

(30) Foreign Application Priority Data

Dec. 22, 2010 (JP) ..... 2010-285788

(51) Int. Cl.
*F21V 7/04* (2006.01)

(52) U.S. Cl.
USPC ..... 362/606; 362/607; 362/620; 362/626

(58) Field of Classification Search
USPC ..... 362/602, 603, 606, 607, 617–620, 362/623–626, 613, 97.1–97.4
See application file for complete search history.

(56) References Cited

U.S. PATENT DOCUMENTS

| | | | | |
|---|---|---|---|---|
| 4,583,151 | A * | 4/1986 | Nagel | 362/29 |
| 2006/0215418 | A1* | 9/2006 | Uehara et al. | 362/606 |
| 2010/0027293 | A1* | 2/2010 | Li | 362/619 |

FOREIGN PATENT DOCUMENTS

JP A-2010-225286 10/2010

* cited by examiner

*Primary Examiner* — Thomas Sember
(74) *Attorney, Agent, or Firm* — Oliff & Berridge, PLC

(57) ABSTRACT

An illuminator is provided including: a light source unit composed of a point light source; a light guide plate including an incidence surface into which light emitted from the light source unit is introduced, and an exit surface out which the light that has been introduced from the incidence surface exits; and a prism body where a plurality of prisms are arranged so as to refract the light that has exited out from the exit surface of the light guide plate, wherein the prism body is arranged at a specific area on the entire exit surface of the light guide plate so as to refract part of the light that has exited out from the exit surface of the light guide plate.

12 Claims, 6 Drawing Sheets

ILLUMINATOR ALLOWING A WIDE LUMINOUS INTENSITY DISTRIBUTION

BACKGROUND OF THE INVENTION

1. Field of the Invention

The present invention relates to an illuminator that allows a wide luminous intensity distribution.

2. Description of the Related Art

Conventionally, when considering light sources for a general lighting purpose used, for example, in indoor situations, an incandescent lamp or a fluorescent lamp has been used; however, through today's technical advancement of blue light-emitting diodes (the LEDs), the LEDs have come into use as the light sources applied to, for example, a ceiling light or a downlight. As one of the examples, FIG. 7 illustrates an edge-light type illuminator 7. This edge-light type illuminator 7 is composed of a light guide plate 1; LEDs 2A, 2A that are arranged at both opposed lateral end surfaces 2C, 2C of the light guide plate 1; a reflection sheet 3 that is arranged on the side of a reflective surface 1B opposed to an exit surface (a main surface 1A) of the light guide plate 1 where lights, which are emitted from the LEDs 2A, 2A and introduced into the opposed lateral end surfaces 2C, 2C of the light guide plate 1, exit out; and an approximately square-shaped diffusion sheet 6 that is arranged on the side of the main surface 1A of the light guide plate 1. A referential numeral 8 illustrates dot-shaped or strip-shaped optical elements that are arranged on the reflective surface 1B of the light guide plate 1, each of the optical elements being approximately formed into a circular, a dot, a square, and the like. In FIG. 7, a referential numeral 2B illustrates an LED array, a referential numeral 4 illustrates a reflector, and a referential numeral 5 illustrates a frame body 5. See, for example, Japanese Patent Application Laid-open No. 2010-225286.

FIG. 8A is now referred. Here, the light guide plate 1 and the diffusion sheet 6 exemplified in FIG. 7 are focused. To satisfy luminous intensity distribution properties of the illuminator provided with the light guide plate 1, a certain wide luminous intensity distribution is required. Here, however, only the provision of the diffusion sheet 6 may not be sufficient in many cases. In this case, as shown in FIG. 8B, the optical element 8 with a complicated contour may be arranged on the main surface 1A of the light guide plate 1. Accordingly, further wide luminous intensity distributions may be achieved. However, when needed to deal with large-sized illuminators, it becomes difficult to manage in case, for example, the contour of the illuminator is changed.

SUMMARY OF THE INVENTION

The present invention has been made in light of the above problem, and it is an object of the present invention to achieve that the luminous intensity distribution properties of an illuminator provided with a light guide plate are allowed to have a wide luminous intensity distribution to be needed.

Embodiments according to the present invention hereinbelow exemplify some structures of the present invention, and are itemized for facilitating understanding of various structures of the present invention. Note that each item does not intend to limit the technical scope of the present invention. While considering the best modes to carry out the present invention, even if components of each item are partially substituted or deleted, or even if another component is added thereto, these should be regarded as the elements of the technical scope of the present invention.

In order to achieve the object described above, according to a first aspect of the present invention, there is provided an illuminator comprising: a light source unit composed of a point light source; a light guide plate including an incidence surface into which light emitted from the light source unit is introduced, and an exit surface out which the light that has been introduced from the incidence surface exits; and a prism body where a plurality of prisms are arranged so as to refract the light that has exited out from the exit surface of the light guide plate, wherein the prism body is arranged at a specific area on the entire exit surface of the light guide plate so as to refract part of the light that has exited out from the exit surface of the light guide plate In the illuminator that is structured as the above, since the prism body is arranged at a specific area on the entire exit surface of the light guide plate to refract part of the exited lights, it makes possible that part of the emitted lights is refracted in a certain direction. With this structure, a necessary wide luminous intensity distribution is achievable by means of the following exited lights: 1) lights that have been exited from the exit surface of the light guide plate and refracted by the prism body; and 2) the other exited lights, that is, lights that have been exited from an area at which the prism body is not arranged.

In the first aspect of the present invention, the plurality of prisms of the prism body are configured as that a luminous intensity distribution of the light emitted from the exit surface of the light guide plate where the prism body is not provided, and a luminous intensity distribution of the light obtainable by which the emitted light is refracted with the prism body have a complementary relation therebetween so as to obtain certain luminous intensity distribution properties.

In the illuminator that is structured as the above, the plurality of prisms of the prism body are configured as that a luminous intensity distribution of the light emitted from the exit surface of the light guide plate where the prism body is not provided, and a luminous intensity distribution of the light obtainable by which the emitted light is refracted by the prism body have a complementary relation therebetween so as to obtain certain luminous intensity distribution properties. Accordingly, a necessary wide luminous intensity distribution is achievable by means of the combination of the following two luminous intensity distributions, that is: 1) a luminous intensity distribution of the exited lights that have been refracted by the prism body; and 2) a luminous intensity distribution of the other exited lights that have exited out from an area on which the prism body is not arranged.

In the first aspect of the present invention, the illuminator further comprises an optical path modification means on a reflection surface facing the exit surface of the light guide plate so that an optical path of the light introduced from the incidence surface of the light guide plate is adapted to direct toward the exit surface of the light guide plate, wherein the optical path modification means is configured as that a luminous intensity distribution of the light emitted from the exit surface of the light guide plate where the prism body is not provided, the optical path of the light being changed by means of the optical path modification means, and a luminous intensity distribution of the light obtainable by which the emitted light is refracted with the prism body have a complementary relation therebetween so as to obtain certain luminous intensity distribution properties.

In the illuminator that is structured as the above, the optical path modification means formed on the reflection surface facing the exit surface of the light guide plate is configured as that a luminous intensity distribution of the light emitted from the exit surface where the optical path is changed due to the optical path modification means, and a luminous intensity distribution of the light that is obtainable by which the emitted light is refracted with the prism body have a complementary relation therebetween so as to obtain certain luminous intensity distribution properties. Accordingly, a necessary wide luminous intensity distribution is achievable by means of the combination of the following two luminous intensity distributions, that is: 1) a luminous intensity distribution of the exited lights that have been refracted by the prism body; and 2) a luminous intensity distribution of the other exited lights that have exited out from an area on which the prism body is not arranged.

In the first aspect of the present invention, the prisms of the prism body and the optical path modification means of the light guide plate are each configured to have a mono-shape in section.

In the illuminator that is structured as the above, a necessary wide luminous intensity distribution is achievable by means of the combination of the following two luminous intensity distributions, that is: 1) a luminous intensity distribution of the lights that have exited out from the exit surface of the light guide plate where the prism body is not provided through the optical path modification means with the mono-shape in section; and 2) a luminous intensity distribution of the emitted lights that have been refracted by the prism body of the single sectional area.

Also, in the above illuminator, considering the light source unit to be influenced the most, the prisms of the prism body and the optical modification means of the light guide plate may be formed to have a mono-configuration in section. Specifically, in a case where the opposed left-and-right lateral end surfaces of the light guide plate are defined as the incidence surfaces, the following structure is possible. That is, the prisms of the prism body and the optical modification means of the light guide plate are bilaterally symmetrical at the center of the light guide plate.

In the first aspect of the present invention, the light guide plate is formed to have a certain symmetrical configuration in a plan view, and the light source unit and the prism body are each arranged to have a certain symmetrical configuration in a plan view.

The illuminator that is structured as the above is composed of: the light guide plate configured to have a certain symmetrical configuration in a plan view; the light source unit arranged to have a certain symmetrical configuration in a plan view; and the prism body to have a certain symmetrical configuration in a plan view so as to refract only part of emitted lights in the entire light that has been emitted from the exit surface of the light guide plate. A necessary wide luminous intensity distribution is thus achievable by means of the following exited lights: 1) exited lights that have been refracted by the prism body; and 2) the other exited lights that have exited out from the exit surface of the light guide plate on which the prism body is not provided.

In the first aspect of the present invention, the light guide plate is formed to have a square configuration in a plan view; each of opposed end surface sides of the light guide plate is formed to define the incidence surface at which the light source unit is each arranged; and the prism body is arranged on at least either a certain near-center area of the light guide plate or a certain area of the opposed end surface sides of the light guide plate.

In the illuminator that is structured as the above, the illuminator is composed of: the light guide plate that is formed to have a square configuration in a plan view; the light source unit; and the prism body that is arranged at a specific portion on the entire exit surface of the light guide plate so as to refract only part of the emitted lights. Accordingly, a necessary wide luminous intensity distribution is achievable by means of the following exited lights: 1) exited lights that have been refracted by the prism body; and 2) the other exited lights that have exited out from the exit surface of the light guide plate where the prism body is not provided. Here, in this corresponding structure, the prism body may be arranged on at least either a certain near-center area of the light guide plate or a certain area of the opposed end surface sides of the light guide plate. Further, the area where the prism body is provided and the area where the prism body is not provided may be alternatively arranged.

In the first aspect of the present invention, all of the opposed end surface sides of the light guide plate is formed to define the incidence surface of the light guide plate at which the light source unit is each arranged.

In the illuminator that is structured as the above, all of the opposed end surface sides of the light guide plate squared in a plan view is formed to define the incidence surface at which the light source unit is each arranged. Accordingly, a necessary wide luminous intensity distribution is achievable by means of the following exited lights: 1) exited lights that have been refracted by the prism body arranged on at least either a certain near-center area of the light guide plate or a certain area of the opposed end surface sides of the light guide plate, 2) the exited lights that have exited out from an area where the prism body is not provided on the exit surface of the light guide plate.

In the first aspect of the present invention, the light source unit and the incidence surface into which the light emitted from the light source unit is introduced are arranged at a center area of the light guide plate in a plan view; and the prism body is arranged on at least either a certain area near the incidence surface or a certain area near the outer periphery of the light guide plate in a plan view.

In the illuminator that is structured as the above, the exited light from the light source unit that is arranged at the center area of the light guide plate in a plan view is introduced into the incidence surface arranged at the center area of the light guide plate in a plan view. Accordingly, a necessary wide luminous intensity distribution achievable by means of the following exited lights: 1) exited lights that have been refracted by the prism body that is partially arranged at a specific area on the entire area of the exit surface of the light guide plate so as to refract part of the exited lights; and exited lights that have exited out from the exit surface of the light guide plate where the prism body is not provided. In this structure, the area where the prism body is arranged can be defined by: at least either a certain area near the incidence surface or a certain area near the outer periphery of the light guide plate in a plan view. Further, the area where the prism body is arranged and the area where the prism body is not arranged may be alternatively arranged.

In the first aspect of the present invention, the light guide plate is formable to have a circular or a polygonal configuration in a plan view.

In the illuminator that is structured as the above, the emitted lights from the light source unit that is arranged at the center area of the light guide plate formed to have a circular or polygonal configuration in a plan view are introduced into the incidence surface arranged at the center area of the light guide plate in a plan view. Accordingly, a necessary wide luminous intensity distribution is achievable by means of the following exited lights: 1) exited lights that have been refracted by the prism body arranged on at least either a certain area near the incidence surface or a certain area near the outer periphery of the light guide plate in a plan view; and exited lights emitted from the exit surface of the light guide plate where the prism body is not arranged.

In the first aspect of the present invention, the prism body is a prism sheet that is provided individually from the light guide plate.

In the illuminator that is structured as the above, the prism body is configured by the prism sheet individually formed from the light guide plate. This includes that: 1) A piece of the prism sheet has a group of prisms at a certain area thereof, and this prism sheet is used in plural; and 2) A piece of the prism sheet has several groups of prisms thereon, and this prism sheet is used alone. Accordingly, a necessary wide light luminous distribution is achievable by means of the following exited lights: 1) exited lights that are refracted by the prisms on the prism sheet individually provided; and the other emitted lights, that is, the emitted lights emitted from the area where the prism body is not arranged on the exit surface of the light guide plate.

In the first aspect of the present invention, a positive prism sheet or an inverse prism sheet is applicable according to a luminous intensity distribution of the light emitted from the exit surface of the light guide plate.

In the illuminator that is structured as the above, according to the luminous intensity distribution of the emitted lights from the exit surface of the light guide plate, the positive prism sheet (the prism sheet where the convex edge lines of the multiple prisms are directed opposite to the light guide plate) and the inverse prism sheet (the prism sheet where the convex edge lines of the multiple prisms are directed toward the light guide plate) are used. Accordingly, a necessary wide luminous intensity distribution is achievable by that a luminous intensity distribution of the emitted light from the exit surface of the light guide plate and a luminous intensity distribution by the emitted light that has been refracted by the prism body have a complementary relation therebetween, thereby being able to obtain desired luminous intensity distribution properties.

In the first aspect of the present invention, the prism body is integrally formable with the exit surface of the light guide plate.

In the illuminator that is structured as the above, the prism body is integrally with but partially arranged at the exit surface of the light guide plate, thereby being able to refract part of the lights exited out from the exit surface of the light guide plate. Accordingly, a necessary wide light intensity distribution is achievable by means of the following exited lights: 1) exited lights that are refracted by the prism body on the exit surface of the light guide plate; and the other emitted lights, that is, the emitted lights emitted from the area where the prism body is not formed at the exit surface of the light guide plate.

In the first aspect of the present invention, the illuminator is mountable at a ceiling or a wall surface.

In the illuminator that is structured as the above, the same operational effects discussed hereinabove is obtainable even though the illuminator is mounted at the ceiling or the wall surface.

BRIEF DESCRIPTION OF THE DRAWINGS

FIG. 4D is a top view with a virtual alternate long and two short dashes line dividing the light guide plate therebetween;

FIG. 2 is another diagram that schematically illustrates a light source unit, a light guide plate and a prism body of an illuminator according to the embodiments of the present invention, where

FIG. 4 schematically illustrates some of the applied examples of a light source unit, a light guide plate and a prism body of an illuminator according to the embodiments of the present invention where

FIG. 5 schematically shows some of the applied examples of a light source unit, a light guide plate and a prism body of an illuminator according to the embodiments of the present invention where

DETAILED DESCRIPTION OF THE PREFERRED EMBODIMENTS

Figure 1A:
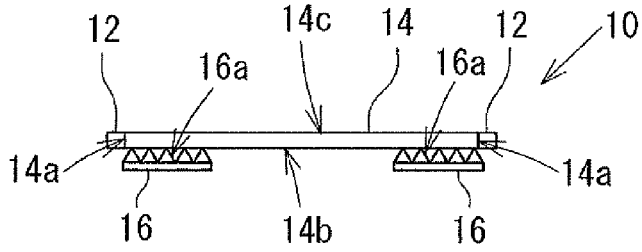
FIG. 1A is a front view.
Figure 1B:
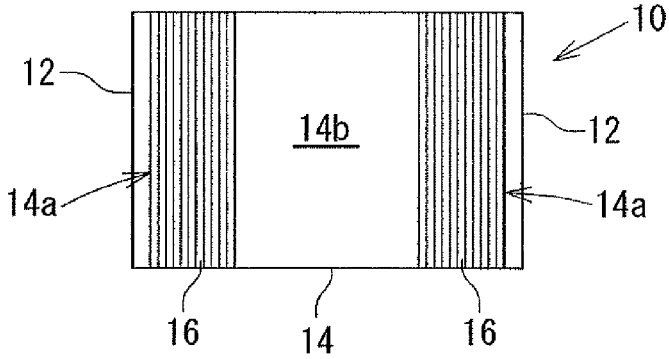
FIG. 1B is a bottom view.

Hereinafter, some embodiments of the present invention will be explained with reference to the accompanied drawings. Here, portions identical with or corresponding to prior arts will be indicated with the same reference numerals, and the detail explanations thereof will be omitted. An illuminator 10 according to the embodiments of the present invention is composed of a light source unit 12, a light guide plate 14, and a prism body 16. Here, the light source unit 12 is linearly illustrated in FIG. 1B for convenience. However, in an actual situation, this means that a plurality of LEDs (that is, point light sources) are arranged. Further, this illuminator 10 includes an electric substrate that supplies current to the light source unit 12, and a cover contributing to the designability of the illuminator 10. Illustration of these parts is however omitted.

The light guide plate 14 is formed by which transparent resin materials such as polycarbonate resin, etc. are shaped into a certain thickness. Further, the light guide plate 14 is formed to have a certain symmetric configuration in a plan view. In FIG. 1, for example, the light guide plate 14 is formed to have a square configuration, which is bilaterally symmetric. Still further, the light guide plate 14 includes an incidence surface 14*a* into which lights emitted from the light source unit 12 is introduced, an exit surface 14*b* where lights that have been introduced from the incidence surface 14*a* exit out, and a reflection surface 14*c* that reflects lights that have been introduced from the incidence surface 14*a*. In the light source unit 12 also, it is adapted to be arranged to have a certain symmetrical configuration in a plan view. In FIG. 1, for example, the light source unit 12 is each arranged at the incidence surface 14*a* positioned on both lateral end surfaces of the light guide plate 14, the light source unit 12 being thus opposed to each other.

Figure 1C:
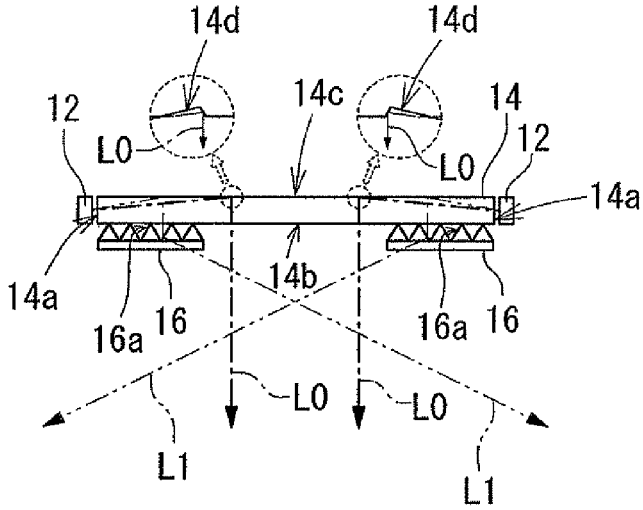
FIG. 1C is an explanatory view that explains that the luminous intensity distribution of lights emitted from the exit surface of the light guide plate where the prism body is not provided, and the luminous intensity distribution If lights obtained by emitted lights that are refracted by the prism body are adapted to have a complementary relation therebetween being thus able to obtain desired luminous intensity distribution properties.
Figure 1D:
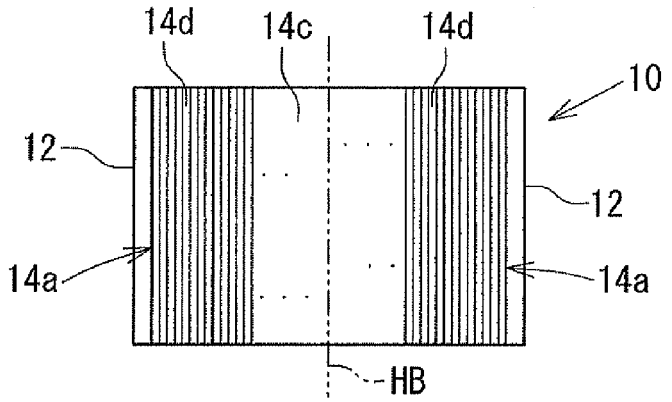
FIG. 1 is a schematic diagram that illustrates a light source unit, a light guide plate and the prism body of an illuminator according to the embodiments of the present invention, where

As shown in FIG. 1C, a plurality of prisms 14*d* are provided on the reflection surface 14*c*, the prisms 14*d* working as an optical path conversion means to change the optical path of lights that have been introduced from the incidence surface 14*a* toward the exit surface 14*b*. In the case of FIG. 1C, each of the prisms 14*d* has a motto-shape in section. Further, as shown in FIG. 1D, the prisms are arranged symmetrically at a hypothetical boundary HB. To be more specific, in each of the prisms 14*d*, the inclined angle of a surface opposed to the nearer light source unit 12 is formed to have a relatively large inclined angle. With this structure, lights emitted from each of the incidence surfaces 14*a*, 14*a* travel into the light guide plate 14. The lights then spread out within the light guide plate 14 and are refracted by the prisms 14*d* so as to exit out in an orthogonal direction relative to the exit surface 14*b*. Here, although illustrated in partially expanded views in FIG. 1C, the prisms 14*d* are actually provided on the whole surface of the reflection 14*c*. See FIG. 1D.

In the example of FIG. 1, each of the prisms 14*d* has a triangular configuration in section; however, as long as it has the optical conversion function as discussed above, the sectional configuration is not limited thereto. For example, the configuration may be circular in section. Further, the prism 14*d* is not limited to a so-called linear prism that has a ridge line extended in a single direction. As shown in Japanese Patent Application Laid-open No. 2010-139754, each of prisms has a ridge line extending so as to intersect with the ridge line of other prisms. These prisms may be alternatively arranged. Moreover, the prisms may be a plurality of domes. Still further, the sectional configuration of the prism 14*d* may be varied according to distance from, for example, the light source unit 12 so as to obtain necessary orientation characteristics. In conclusion, the prism 14*d* is not limited to a single configuration.

The prism body 16, in the example of FIG. 1, is a prism sheet individually arranged from the light guide plate 14. A plurality of prisms 16*a* are arranged on the prism body 16 so that emitted light L0 from the exit surface 14*b* of the light guide plate 14 is adapted to refract with the prism body 16 in a direction mainly toward the light source unit 12 on the farther side (see the emitted light L1). Here, by adjusting the actual angular distribution of the emitted light L1 and/or the configuration of the prism 16*a*, more lights can be directed toward the light source unit 12 on the near side. In the example of FIG. 1, every prism 16*a* of the prism body 16 has a mono-shape in section. Further, the prism 16 is arranged at a certain area on the exit surface 14*b* of the light guide plate 14 for refracting only partial emitted lights. Still further, the prism body 16 is arranged to have a certain symmetrical configuration in a plan view at the hypothetical boundary HB. In FIG. 1, two pieces of the prism bodies 16 are arranged at a certain area positioned on each lateral end surface of the light guide plate 14 (adjacent to each of the incidence surfaces 14*a*, 14*a*).

The prism 16*a* of the prism body 16 is formed as that a luminous intensity distribution of the emitted light L0 from the exit surface 14*b* of the light guide plate 14 where the prism body 16 is not provided, and a luminous intensity distribution of the emitted light L1 obtainable by which the emitted light L0 is refracted by the prism body 16 have a complementary relation therebetween being thus able to obtain desired luminous intensity distribution properties. As discussed hereinabove, in the example of FIG. 1, the incident light has spread out in the light guide plate 14, and the optical path thereof is changed by means of each of the prisms 14*d*. Since the incident light is refracted so as to emit in an orthogonal direction relative to the emitted surface 14*b*, the prism body 16 is arranged to form an inverse prism sheet where the convex ridges of the plurality of prisms 16*a* are directed toward the light guide plate 14. In other words, the prism 14*d* formed on the reflection surface 14*c* of the light guide plate 14 is configured as that a luminous intensity distribution of the emitted light L0 from the exit surface 14*b* where the prism body 16 is not provided (here, the optical path of the emitted light L0 is changed by the prism 14*d*), and a luminous intensity distribution of the emitted light L1 obtainable by which the emitted light L0 is refracted by the prism body 16 have a complementary relation therebetween being able to obtain desired luminous intensity distribution properties. In FIG. 1C, the emitted light L0 illustrated by an alternate long and short dash line and the emitted light L1 illustrated by an alternate long and two short dashes line are allowed for a certain degree of angle width in an actual situation. See FIG. 3A.

Also, in the prism 16*a* of FIG. 1, although illustrated in a triangular section, as long as the prism 16*a* obtains the above optical conversion functions, the sectional configuration is not limited thereto. For example, the configuration of the prism 16*a* may be circular in section. Further, the prism 16*a* is not limited to a linear prism where the ridges thereof extend in a single direction. The prisms where the ridges thereof extend in an intersecting manner may be alternatively arranged. Further, the section of the prism 16*a* may be varied according to distance from, for example, the light source unit 12, thereby being able to obtain necessary orientation properties. Thus, the prism 14*d* is not limited to a certain mono-shape. Still further, the inclined angle of the prism 14*d* of the light guide plate 14 as well as the inclined angle of the prism 16*a* of the prism body 16 are optionally adjustable according to orientation distributions to be required.

Figure 2A:
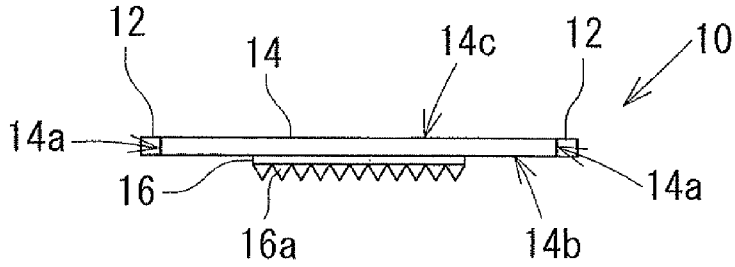
FIG. 2A is a front view.
Figure 2B:
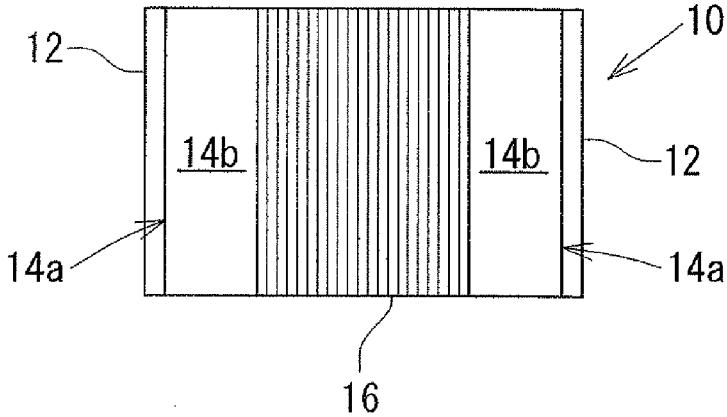
FIG. 2B is a plan view (a bottom view)
Figure 2C:
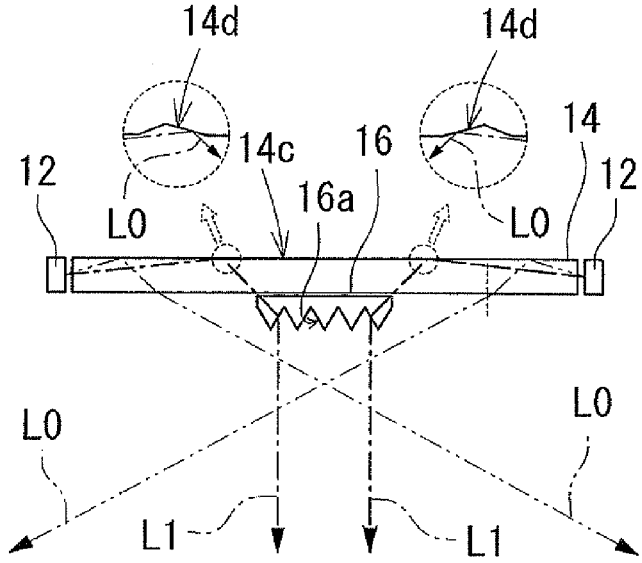
FIG. 2C is an explanatory view that explains that the luminous intensity distribution of lights emitted from the exit surface of the light guide plate where the prism body is not provided, and the luminous intensity distribution of lights obtained by emitted lights that are refracted by the prism body are adapted to have a complementary relation therebetween being thus able to obtain desired luminous intensity distribution properties.

Next, FIG. 2 illustrates another example of a light source unit 12, a light guide plate 14 and a prism body 16. Embodiments illustrated in FIG. 2 are different from the ones illustrated in FIG. 1 as follows. That is, each prism 14*d* of the light guide plate 14 is formed as that the inclined surface angle of the prism 14*d* facing the light source unit 12 on the near side is formed to be relatively small. With this configuration, lights that have been introduced from each incidence surface 14*a* into the light guide plate 14 are refracted at angle smaller than critical angle relative to an emitted surface 14*b*. Further, the lights are refracted with the prism 14*d* so as to advance toward the light source unit 12 on the farther side. Still further, only a piece of the prism body 16 is arranged at a certain central area on the light guide plate 14. Here, the prisms 14*d* illustrated in partially, expanded views in FIG. 2C are arranged on the whole surface of the reflection surface 14*c* in an actual situation.

As shown in FIG. 2C, the prism body 16 is a positive prism sheet where the convex ridges of prisms 16*a* are directed opposite to the light guide plate 14. With this configuration, lights are introduced into the light guide plate 14, and the optical path of the lights is changed by means of each of the prisms 14*d*. Emitted light L0 that is emitted toward the light source unit 12 on the farther side will become emitted light L1 which is emitted in a direction orthogonal relative to the emitted surface 14*b* by means of the plurality of prisms 16*a* on the prism body 16. Here, in FIG. 2C, the emitted light L0 illustrated by an alternate long and two short dashes line and the emitted light L1 illustrated by an alternate long and short dash line are allowed for a certain degree of angle width in an actual situation. See FIG. 3A.

According to the embodiments of the present invention as discussed hereinabove, the following operational effects are obtainable. Considering the illuminator 10, by arranging the prism body 16 only on the certain area of the emitted surface 14*b* of the light guide plate 14, the emitted lights L0 are partially refracted in a desired direction. Accordingly, a necessary wide luminous intensity distribution can be achieved through the emitted light L1 that has been emitted from the exit surface 14*b* of the light guide plate 14 and that has been refracted by the prism body 16, and the other emitted lights, that is, the emitted light L0 that has been emitted form an area where the prism body 16 is not arranged on the exit surface 14*b* of the light guide plate 14.

According to the example of FIG. 1C, in a case where the illuminator 10 is set on a ceiling surface, the emitted light L0 emitted from an area where the prism body 16 is not provided will mainly illuminate a floor surface right under the illuminator 10 (the just-below floor surface). On the other hand, the emitted light L1 that has been refracted by the prism body 16 will mainly illuminate a floor surface outside of the just-below floor surface (the outside floor surface). In the case of FIG. 2C, the emitted light L1 that has been refracted by the prism body 16 will mainly illuminate the just-below floor surface of the illuminator 10. On the other hand, the emitted light L0 emitted from an area where the prism body 16 is not provided on the exit surface 14*b* of the light guide plate 14 will illuminate the outside floor surface of the illuminator 10.

As shown above, the prism 16*a* of the prism body 16 is formed as that a luminous intensity distribution of the emitted light L0 from the exit surface 14*b* of the light guide plate 14 where the prism body 16 is not provided, and a luminous intensity distribution of the emitted light L1 obtainable by which the emitted light is refracted by the prism body 16 have a complementary relation therebetween thereby being able to obtain desired luminous intensity distribution properties. Accordingly, a necessary wide luminous intensity distribution can be achieved through a combination of 1) a luminous intensity distribution of the emitted light L1 that have been refracted by the prism body 16; and 2) a luminous intensity distribution of the emitted light L0 that has exit out from an area where the prism body 16 is not arranged on the exit surface 14*b* of the light guide plate 14.

In other words, the optical path modification means 14*d* formed on the reflection surface 14*c* of the light guide plate 14 is formed as that a luminous intensity distribution of the emitted light L0 that is emitted from the emitted surface 14*b*, the optical path of the emitted light L0 being changed by means of the optical path modification means 14*d*, and a luminous intensity distribution of the emitted light L1 obtainable by which the emitted light is refracted by the prism body 16 have a complementary relation therebetween thereby being able to obtain desired luminous intensity distribution properties. Accordingly, a necessary wide luminous intensity distribution can be achieved through a combination of 1) a luminous intensity distribution of the emitted light L1 that have been refracted by the prism body 16; and 2) a luminous intensity distribution of the emitted light L0 that have been emitted from an area where the prism body 16 is not arranged on the exit surface 14*b* of the light guide plate 14. The size and the inclined angle of both the light path modification means 14*d* formed on the reflection surface 14*c* of the light guide plate 14 and the prism 16*a* of the prism body 16 are optionally adjustable, so that an area to be illuminated will be thus adjustable accordingly.

In addition to the above, since the illuminator according to the embodiments of the present invention is composed only of the light source unit 12, the light guide plate 14, and the prism body 16, its member composition can be said as simple, but its light extraction efficiency can be kept at an advanced level. Further, through the optical path modification means 14*d* with a mono-shape in section, a necessary wide luminous intensity distribution can be achieved by a combination of 1) a luminous intensity distribution of the emitted light L0 that has exited out from an area where the prism body 16 is not arranged on the exit surface 14*b* of the light guide plate 14; and 2) a luminous intensity distribution of the emitted light L1 that has been refracted by the prism body 16 with a mono-shape in section. With this sectional mono-shape, it becomes possible to manufacture the light guide plate 14 and the prism body 16 through well-known and general methods thereby readily responding to a demand for large-sized applications.

Figure 3A:
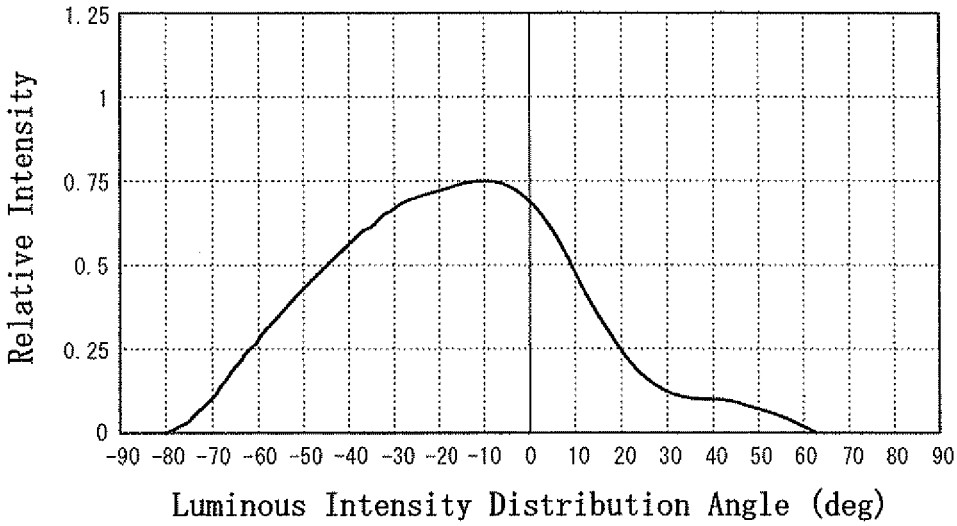
FIG. 3A is a diagram that illustrates the luminous intensity distribution of the light guide plate in FIG. 1.
Figure 3B:
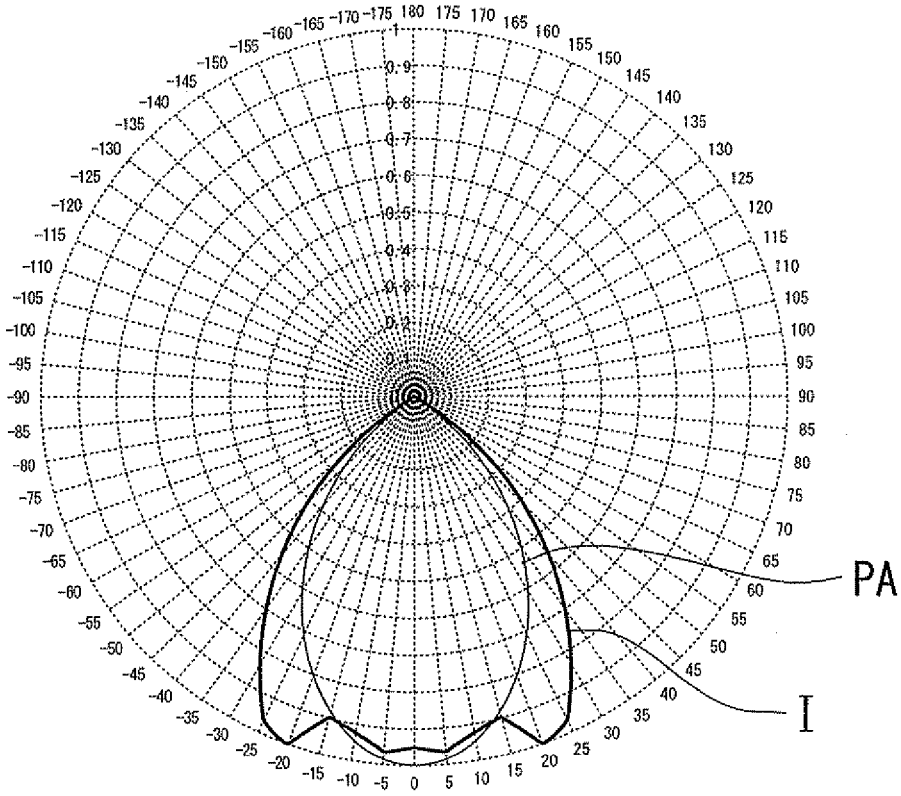
FIG. 3B is a diagram that illustrates the luminous angle distribution of the illuminator.

In FIG. 3A, the light intensity distribution of a particular case is shown. That is, the light source unit 12 is arranged at the incidence surface 14*a* of only the right side of the light guide plate 14 illustrated in FIG. 1. In this case, the following can be concluded. Lights emitted from the exit surface 14*b* of the light guide plate 14*a* are adapted to exit out slightly in a forward direction (in a direction coming away from the incidence surface 14*a* on the right side). This indicates that although the emitted light distribution is deviated, lights in totality will be emitted out in an orthogonal direction relative to the emitted surface 14*b*. With this construction, by arranging the prism body 16 in a manner as shown in FIG. 1, its illuminance angle distribution will have a wide range (a wide light intensity distribution). See FIG. 3B. Here, in FIG. 3B, PA indicates a luminous angle distribution without the prism body 16 while I indicates a luminous angle distribution with the prism body 16.

Figure 4A:
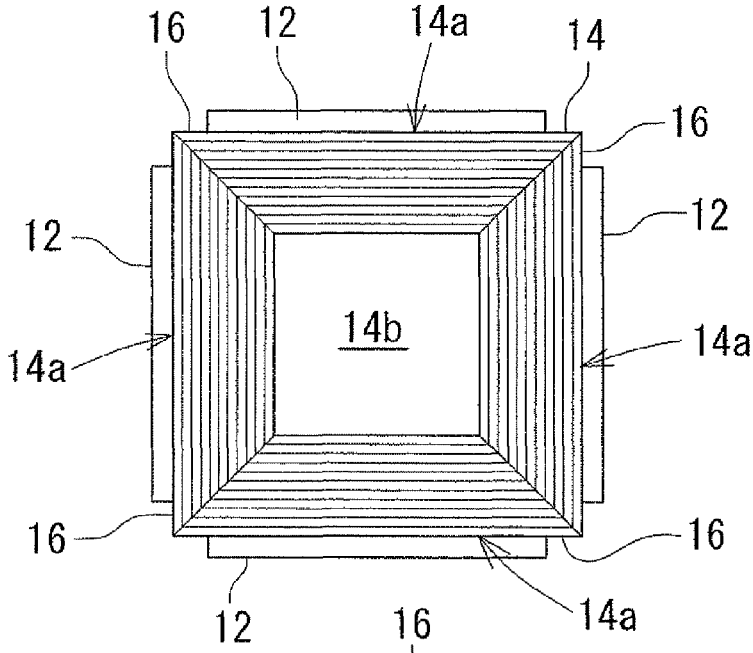
FIG. 4A shows an example that the light guide plate is formed into square in a plan view, and the light source unit is each arranged at all opposed lateral end surfaces.
Figure 4B:
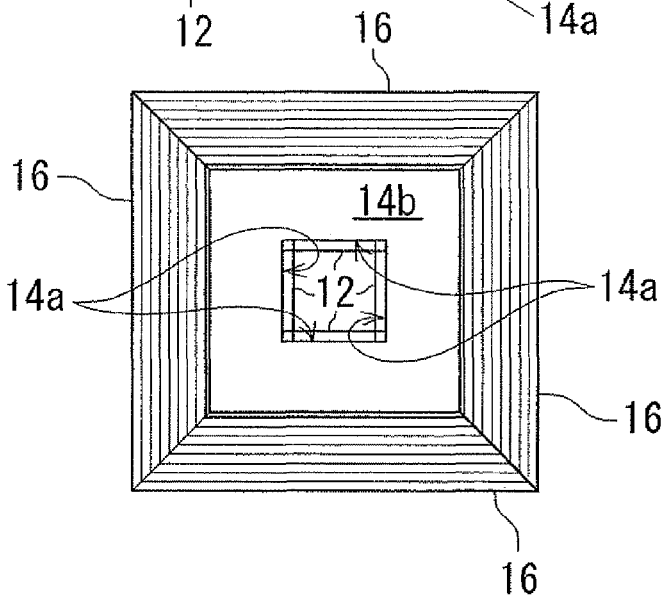
FIG. 4B shows an example that the light guide plate is formed into square in a plan view, and the light source unit is each arranged at the central portion of the light guide plate.
Figure 4C:
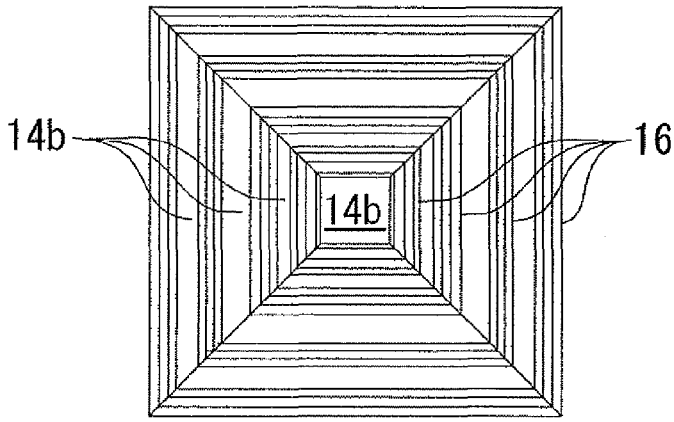
FIG. 4C shows an example that the light guide plate is formed into square in a plan view, and an area defined by the prism body arranged and the other area defined by the prism body not arranged are alternatively provided.

In FIG. 4, some applied examples of the light guide plate 14 and the prism body 16 are illustrated. In FIG. 4A, the light guide plate 14 is square in a plan view. All opposed lateral end surfaces of the light guide plate 14 are incidence surfaces 14*a*, each of the light source units 12 being arranged at each of the opposed incidence surfaces 14*a*. In FIG. 4B, the light guide plate 14 is square in a plan view. Opening is furnished at the center of the light guide plate 14. The incidence surfaces 14*a* are each formed at the lateral end surfaces of the opening. The light source units 12 are each arranged at each of the incidence surfaces 14*a* of the light guide plate 14. In FIG. 4C, the light guide plate 14 is square in a plan view. Here, the area where the prism body 16 is arranged and the area where the prism body 16 is not arranged are alternatively formed. In FIG. 4C, the light source unit 12 is omitted. However, any arrangements shown in FIGS. 4A and 48 are applicable. Moreover, in FIG. 4, the irradiation range of the light source unit 12 is adjustable at every lateral end surface of the light guide plate 14, thereby making possible to achieve a further wide view than the case of FIGS. 1 and 2.

Figure 5A:
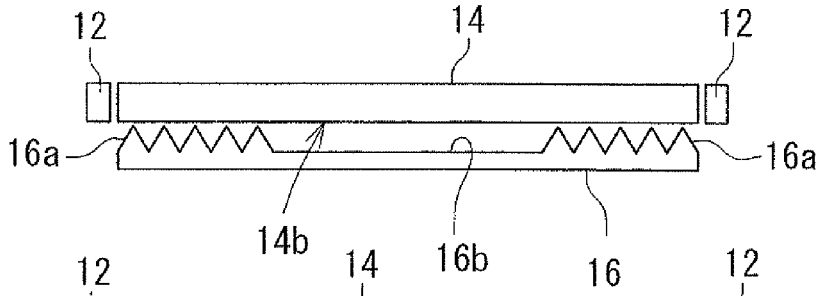
FIG. 5A shows an example that an inverse prism sheet, which is individually arranged from the light guide plate, is used.
Figure 5B:
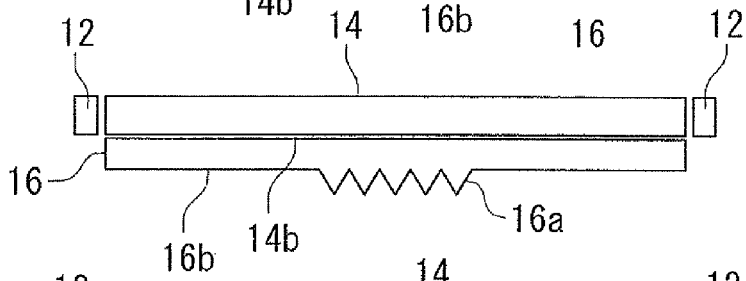
FIG. 5B shows an example that a positive prism sheet as the prism body, which is individually arranged from the light guide plate, is used.
Figure 5C:
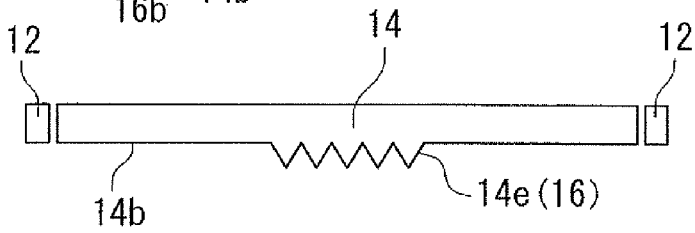
FIG. 5C shows an example that the prism body is integrally formed on the exit surface of the light guide plate.

In FIG. 5, some applied examples of a light source unit 12, a light guide plate 14 and a prism body 16 of an illuminator according to the embodiments of the present invention are illustrated. In FIG. 5A, a prism body 16 is an inverse prism. Two separated prisms 16*a*, 16*a* are integrally connected through a flat portion 16*b* placed therebetween. In FIG. 5B, the prism body 16 is a positive prism sheet. The prism 16 is placed at the center portion of the flat portion 16*b*. In every case, the prism body 16 covers the whole surface of an emitted surface 14*b* of the light guide plate 14. With this structure, the positioning of the light guide plate 14 and the prism body 16 will be facilitated. Especially in the case of FIG. 5A, two pieces of the prisms 16*a*, each of which is placed separately, do not require a mutual positioning. This type of the prism body 16 may be fabricated by which a prism-sheet piece is laminated on a transparent sheet having substantially the same size with the light guide plate 14. Still further, in the case of FIG. 5C, by directly forming a prism 14*e* on the exit surface 14*b* of the light guide plate 14, the prism body 16 can be integrally configured with the exit surface 14*b* of the light guide plate 14.

Figure 6:
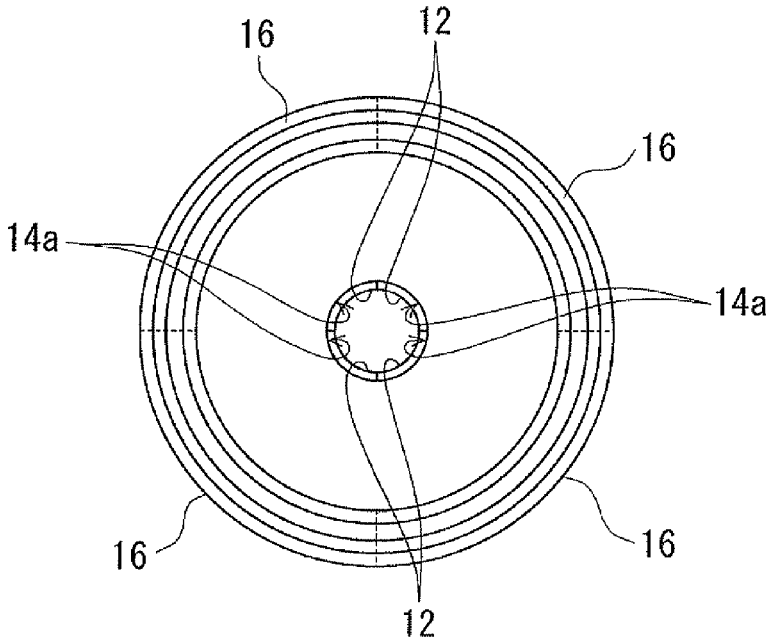
FIG. 6 is a plan view (a bottom view) that schematically illustrates the applied example of a light source unit, a light guide plate, and a prism body of an illuminator according to the embodiments of the present invention where the light guide plate is exemplified to have a circular configuration in a plan view.
Figure 7:
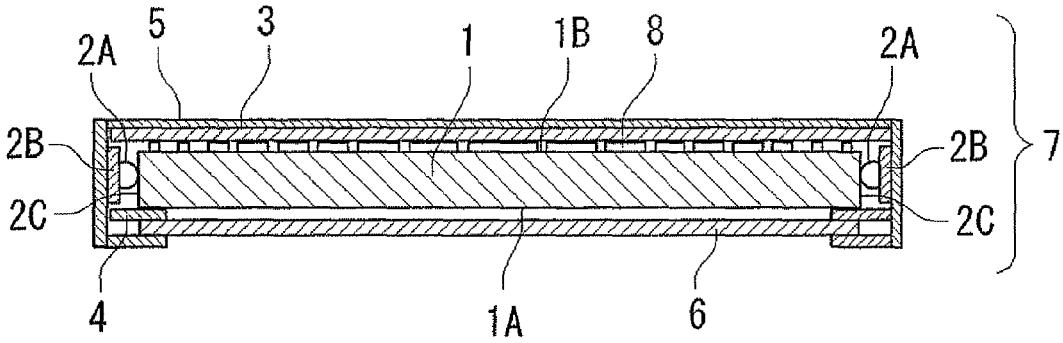
FIG. 7 Prior Art
FIG. 7 is a conventional sectional view of an edge-light type illuminator.
Figure 8A:
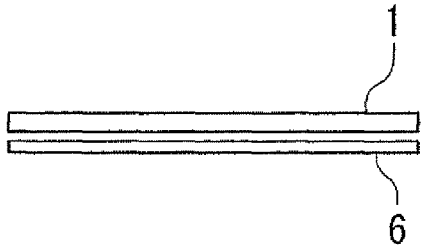
FIG. 8A Prior Art
FIG. 8A is a schematic diagram where, in the edge-light type illuminator in FIG. 7, the light guide plate and the diffusion sheet are focused, and FIG. 8B also schematically illustrates that the plurality of optical elements with a complicated formation are arranged on the exit surface of the light guide plate in FIG. 8A.
Figure 8B:
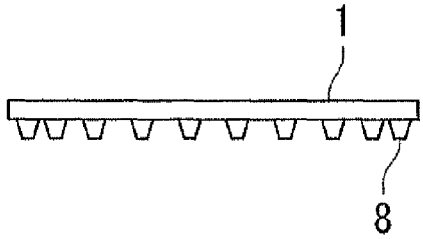
FIG. 8B Prior Art

In FIG. 6, a light guide plate 14 is circularly formed in a plan view. In this example, as the same with the FIG. 4B, opening is formed at the center of the light guide plate 14. An incidence surface 14*a* is each formed at the lateral end surfaces of the opening. Each light source unit 12 is arranged at each of the incidence surfaces 14*a*. Here, as the same with the FIG. 4A, external lateral end surfaces of the light guide plate 14 may be formed as the incidence surface 14*a*. The light source unit 12 is then arranged at each of the external lateral end surfaces. Further, in the example of FIG. 6, the light source unit 12 and the prism body 16 are divided into 4 in a circumferential direction. However, the light source unit 12 and the prism body 16 may be integrally formed. Further, although not illustrated, even if the light guide plate 14 is formed into other polygonal configurations besides square, the identical operation effects are obtainable.

What is claimed is:

1. An illuminator comprising:

a light source unit composed of a point light source;

a light guide plate including an incidence surface into which light emitted from the light source unit is introduced, and an exit surface out which the light that has been introduced from the incidence surface exits;

a prism body where a plurality of prisms are arranged so as to refract the light that has exited out from the exit surface of the light guide plate, wherein the prism body is arranged at a specific area on the entire exit surface of the light guide plate so as to refract part of the light that has exited out from the exit surface of the light guide plate; and an optical path modification means on a reflection surface facing the exit surface of the light guide plate so that an optical path of the light introduced from the incidence surface of the light guide plate is adapted to direct toward the exit surface of the light guide plate;

wherein the optical path modification means is configured so that a luminous intensity distribution of the light emitted from the exit surface of the light guide plate where the prism body is not provided, the optical path of the light being changed by means of the optical path modification means, and a luminous intensity distribution of the light obtainable by which the emitted light is refracted with the prism body have a complementary relation therebetween so as to obtain certain luminous intensity distribution properties.

2. An illuminator according to claim 1, wherein the plurality of prisms of the prism body are configured as that a luminous intensity distribution of the light emitted from the exit surface of the light guide plate where the prism body is not provided, and a luminous intensity distribution of the light obtainable by which the emitted light is refracted with the prism body have a complementary relation therebetween so as to obtain certain luminous intensity distribution properties.

3. An illuminator according to claim 1, wherein the prisms of the prism body and an optical path modification means of the light guide plate are each configured to have a mono-shape in section.

4. An illuminator according to claim 1, wherein the light guide plate is formed to have a certain symmetrical configuration in a plan view, and the light source unit and the prism body are each arranged to have a certain symmetrical configuration in a plan view.

5. An illuminator according to claim 1, wherein the light guide plate is formed to have a square configuration in a plan view; each of opposed end surface sides of the light guide plate is formed to define the incidence surface at which the light source unit is each arranged; and the prism body is arranged on at least either a certain near-center area of the light guide plate or a certain area of the opposed end surface sides of the light guide plate.

6. An illuminator according to claim 5, wherein all of the opposed end surface sides of the light guide plate is formed to define the incidence surface of the light guide plate at which the light source unit is each arranged.

7. An illuminator according to claim 1, wherein the light source unit and the incidence surface into which the light emitted from the light source unit is introduced are arranged at a center area of the light guide plate in a plan view; and the prism body is arranged on at least either a certain area near the incidence surface or a certain area near the outer periphery of the light guide plate in a plan view.

8. An illuminator according to claim 7, wherein the light guide plate is formable to have a circular or a polygonal configuration in a plan view.

9. An illuminator according to claim 1, wherein the prism body is a prism sheet that is provided individually from the light guide plate.

10. An illuminator according to claim 9, wherein a positive prism sheet or an inverse prism sheet is applicable according to a luminous intensity distribution of the light emitted from the exit surface of the light guide plate.

11. An illuminator according to claim 1, wherein the prism body is integrally formable with the exit surface of the light guide plate.

12. An illuminator according to claim 1, wherein the illuminator is mountable at a ceiling or a wall surface.

* * * * *